United States Patent [19]

Scharlin

[11] 4,143,889

[45] Mar. 13, 1979

[54] LARGE PRINT BOOKS AND METHOD FOR PRODUCING THE SAME FROM REGULAR SIZE BOOKS

[76] Inventor: John A. Scharlin, 510 E. Andover Dr., Burbank, Calif. 91504

[21] Appl. No.: 859,274

[22] Filed: Dec. 12, 1977

Related U.S. Application Data

[63] Continuation-in-part of Ser. No. 613,620, Sep. 15, 1975, Pat. No. 4,073,510.

[51] Int. Cl.[2] ..... B42C 1/00

[52] U.S. Cl. ..... 281/15 R; 11/1 R; 281/38; 283/63 R

[58] Field of Search ..... 281/1, 15 R, 38; 283/63 R; 11/1 R

[56] References Cited

U.S. PATENT DOCUMENTS 3,593,987 7/1971 Garber ..... 281/38 X

*Primary Examiner*—Travis S. McGehee

[57] ABSTRACT

An enlarged print book is produced by microfilming the front and back pages or sides of each sheet of an original book, preparing an enlarged print of each page from the microfilm, severing each page approximately in half on a separation line compatible with the printed matter thereon for subsequent binding at the separation, preparing printing plates of the bottom of one page and the top of the succeeding page in the book with the separation lines registered for subsequent binding, printing on one side of a quantity of sheets the bottom of said one page and on the other side of the quantity of sheets the top of the succeeding page, collating the sheets, and binding them together with the separation lines at the binding and the printed matter registered to form a book which, when opened, exposes the enlarged top half of each page of the original book above the enlarged bottom half of the same page of said original book.

14 Claims, 11 Drawing Figures

LARGE PRINT BOOKS AND METHOD FOR PRODUCING THE SAME FROM REGULAR SIZE BOOKS

Figure 1:
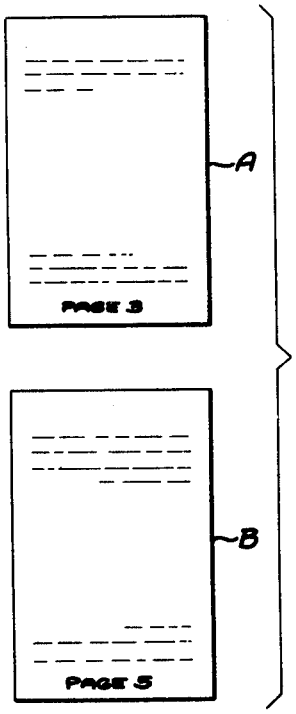

This application is a continuation-in-part of my pending application, Ser. No. 613,620, filed Sept. 15, 1975, now U.S. Pat. No. 4,073,510 and having the same title.

The present invention relates to printed matter, and more particularly to enlarged print books made from original or smaller size books, and to methods for producing such enlarged print books.

Large print books are made for individuals who are classified as "legally blind". Such individuals may have only 10% or less of normal vision in only one eye. Average type sizes of 6 pt to 12 pt are very difficult or impossible for them to read. However, since these people are not completely blind, they can be educated with regular schooling in normal classrooms to be self-supporting, provided textbooks and other printed matter can be enlarged sufficiently for them to read.

Enlarged single-copy books, as opposed to multi-copy, standard ink-printing books, having large type sizes are necessitated by the fact that usually one person, such as a student, may be taking a certain in a school which requires a textbook that may never be required by another visually impaired individual in the entire country. Currently, single-copy, large print books have been produced as a result of microfilming the original smaller size book page by page-by-page, and then enlarging the film frames on a suitable machine, such as a xerographic machine, of a known type. Essentially, the large print book is a standard xerographic copy obtained through use of a microfilm negative and a specialized xerographic or Xerox Copyflo printer to achieve the required enlargement.

Enlarged print books, prior to the invention described and claimed in my application for patent identified above, were usually from 11 × 15 inches to 11 × 17 inches in page size. These oversized print books result from the process of enlarging the type from the original book by 150% to 300%, which also obviously enlarges the entire page size of the original book. The special problem created by this technique is not only the physical difficulty of a blind person, or anyone else, handling a very large book, but, more importantly, almost all of the visually handicapped persons share a strong psychological aversion to being considered "different". They often will not read at all, rather than carry around an oversized book. It, therefore, becomes very important to the education of these handicapped individuals to make their reading material appear outwardly as normal and conventional as possible.

A prior enlarged print book has also been made which involves the microfilming of the top and bottom halves of each page, enlarging each half, glueing the bottom half of one page to the top half of the next succeeding page in back-to-back relation, and then binding the glued pages together. When the book is opened, the original top half of a page of the original book has the bottom half of the same page of the original book immediately below it, permitting the enlarged top and bottom halves of the same page to be read in the same manner as in the original book. With the glue technique, large print books can be made of substantially the same size, when closed, as the original work.

In the production of large print books embodying the glueing technique, difficulties are encountered. The enlarged top and bottom halves must be physically glued together, and this glueing step must be performed for every copy produced. The book is subject to deterioration of the glue, inadequate control over illustrations, charts and other continuous image formats, and presents considerable problems with two or three column book formats in which the open space between the lines of type do not align with one another. All of the above individual steps of half page production and glueing must be repeated each and every time a copy of any book is produced.

Through use of applicant's method, according to the above-identified application for patent, large print books can be produced without having an oversized format; that is, books up to 11 × 17 inches in size. That method enlarges the top and bottom half of each page of the original book to normal book page size, which may range from 6 × 8 inches to 8½ × 11 inches. Yet the original full-page format of the original book is preserved when the large print book is opened for reading. Basically, enlarged prints of the bottom one-half of one page and the top one-half of the following page are printed on a single sheet of paper. The resulting page is folded in half, which is true of all following pages, which are then bound together at their open ends. When the book is opened, the original full page reads continuously from top to bottom of the large print book, or in the same manner as the same page is read from the original print book. Not only is the text read continuously from top to bottom, but illustrations and figures continue from each half page to the next half page, with such illustrations and figures closely adjacent or contiguous one another and in proper alignment. That method provides a book which gives the appearance of two-sided printing without completely reforming the book. It results in a book that is normal looking in overall size when in a closed condition.

Additional copies are easily produced once the microfilm of the bottom half of one page above the top half of the following page has been created. Additional copies can be produced easily from such microfilm since it is only necessary to print each composite sheet to the desired size from the microfilm frames, trim the top and bottom edges, fold each sheet in half, and then bind all the tip and bottom edges, fold each sheet in half, and then bind all the sheets so formed in successive order. Individual glueing of half pages, as in the prior art design, is not required. The book according to that application for patent may be characterized as a simulated printed book.

The present invention relates to a further improved large print book and method for making the same utilizing a printing procedure whereby, instead of providing the respective pages on sheets which are folded at the top and bottom of each sheet to form composite sheets of double the paper thickness, the respective half sheets are printed on opposite sides with the matter from the bottom of one page and the top of the succeeding page.

Production of large print books according to my above-identified application, by folding the sheets containing the top of one page and the bottom of the adjacent page, has wide application for use by the legally blind, having say on the order of 10% normal vision, or less. In the case that a relatively small quantity of large print books are to be produced, for the usually small number of persons requiring such books in a given area, school district or state, the procedure is superior to those previously available.

However, in the case where certain large print books may be adapted on a larger basis requiring the production of larger quantities of a given standard book, there has remained a need for an even further improvement in the production of large print books from standard books.

The present invention provides for the production of large print books by utilization of a printing procedure in combination with certain of the procedures of the method of the above-identified application for patent, whereby an improved large print replica of a standard book can be produced in substantial quantities at a more economical rate.

In accomplishing the foregoing, the present invention provides steps involving serving enlarged prints of the pages of a book approximately along the middle of the page, to obtain tops and bottoms of each page, and then preparing printing plates of a desired enlarged size of the bottom of each page and the top of the succeeding page, the respective tops and bottoms then being printed on opposite sides of a single sheet, of half the size of an enlarged page, the printed half-page sheets then being collated and bound to provide enlarged printed replicas of the original book.

This invention possesses many other advantages and has other purposes which may be made more clearly apparent from a consideration of a form and method embodying the invention. This form and method are shown and described in the present specification and in the drawings accompanying and constituting a part thereof. They will now be described in detail, for the purpose of illustrating the general principles of the invention; but it is to be understood that such detailed description is not to be taken in a limiting sense.

Figure 10:
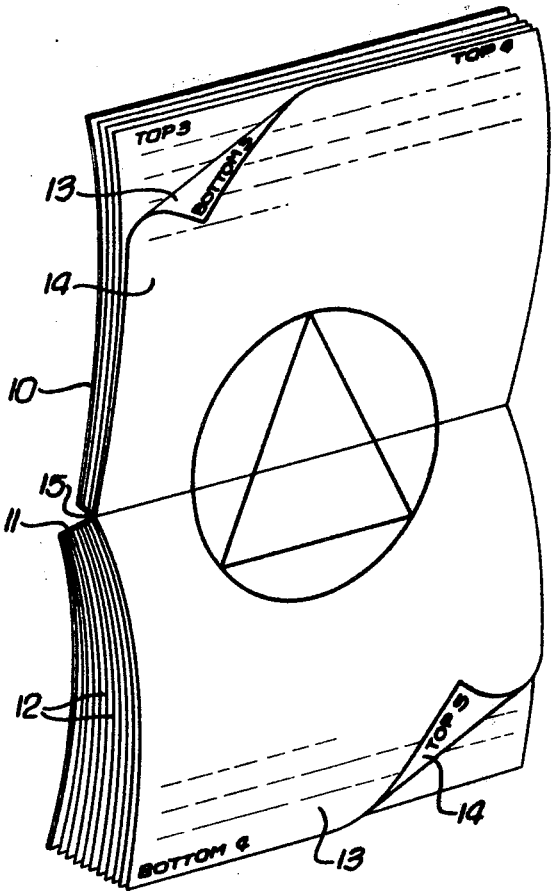
Figure 9:
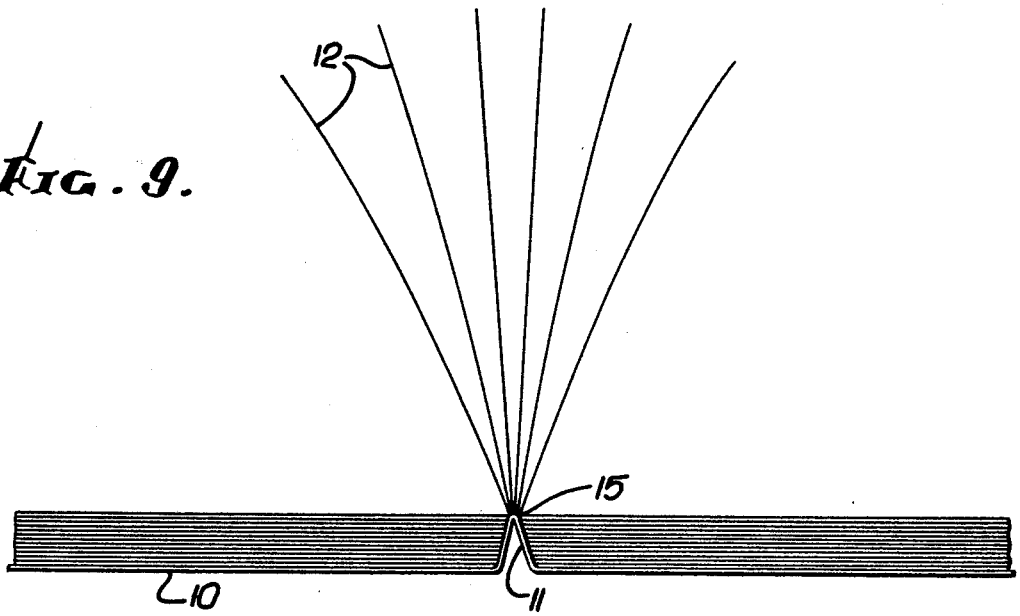

Referring to the drawings:

FIGS. 1 to 8, inclusive, illustrate successive steps of producing printed large print books according to the invention;

FIG. 9 is an end view of an opened, bound book embodying applicant's invention; and FIG. 10 is an isometric view of the finished book in an open condition.

A large print book is illustrated in FIGS. 9 and 10, which is produced by following the steps disclosed in FIGS. 1 to 8, inclusive. The book itself includes a cover 10 having a central binding 11 to which printed sheets 12 are glued, or otherwise secured. Each sheet is derived from a regular book, consisting of the bottom half 13 of a page of the book and the top half 14 of the next succeeding page of the book, these two half pages being printed on opposite sides of sheets 12. When the book is opened, as, for example, to page 4 (FIG. 10), the top half 14 of page 4 will appear on the upper sheet above the binding 11; whereas, the bottom half 13 of page 4 will appear on the lower sheet below the binding. The tops and bottoms together are an enlarged duplicate of page 4 of the original or regular book from which the composite book is made, as will be later described. Printed on the reverse side of the sheet 12, showing the top of page 4, is the matter from the bottom 13 of page 3 of the original book and printed on the reverse side of sheet 12 showing the bottom of page 4 is the top 14 of page 5 of the original book.

Each sheet 12, comprising the bottom half 13 of one page and the top half 14 of the succeeding page, has its binding edge 15 glued or otherwise secured to the binding 11 so as to give the book a regular appearance when closed, the top 14 and bottom 13 of the same number page being contiguous at the binding 11 and closely adjacent one another so as to give the same appearance as a continuous page, corresponding to the same numbered page of the regular book from which the enlarged book has been made.

In producing the large print book illustrated in FIGS. 9 and 10 from a regular size book, the regular size sheets are cut loose from the original binding. Two severed sheets A and B are disclosed in FIG. 1, by way of example, representing page 3 of one sheet A and page 5 of the next sheet B. The reverse sides of the sheets will be pages 4 and 6, respectively. Both sides of each sheet are then microfilmed as illustrated in FIG. 2. Thus, the first frame 3, representing a side of sheet A appears on the microfilm, which may be 35mm film, page 4 of sheet A then being filmed as frame 4, which is followed by a side of sheet B which will be frame 5 of page 5, and the reverse side of sheet B which is frame 6 of page 6. Microfilm frames 7, etc. of both sides or pages of each succeeding severed book sheet are then made.

Figure 3:
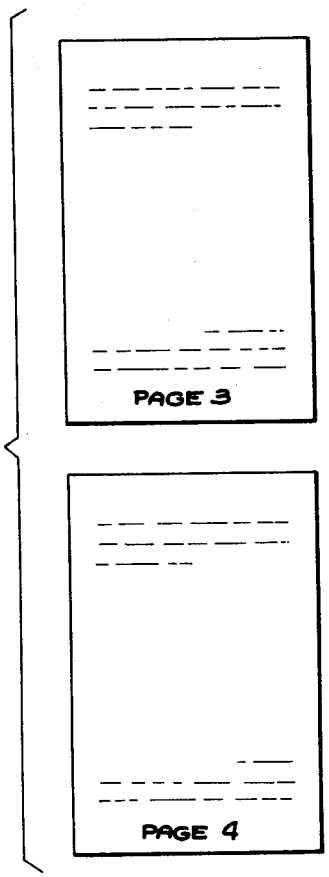

A print of each page 3, 4, 5, 6, etc. is made from the frames and enlarged to the desired extent, which may, by way of example, be about 125% of the size of the original book page, separate pages 3 and 4 being represented, by way of example, on FIG. 3 as being enlarged, single-sided copies of each sheet, such as sheet A. The reverse side of each of such enlarged copies of the pages in blank.

Figure 4:
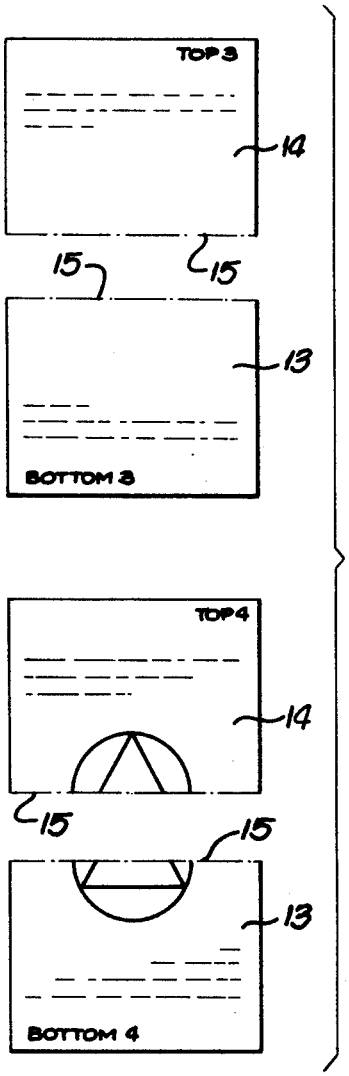

Each enlarged single-sided copy is then cut approximately in half, as disclosed in FIG. 4, to provide the edges 15, corresponding to the binding edges 15 of FIGS. 9 and 10. Each cut is made between lines of type or text so that a printed line is not severed. Illustrations, diagrams, and the like, may be severed by the cut, as disclosed in the representation of page 4 on FIG. 4. The half page need not be, and seldom would be, exactly one-half of the enlarged print, and may be plus or minus ½" off the middle. The cut, moreover, need not be at a right angle across the page, but may be at an angle or jogged around letters, images or designs.

Figure 5:
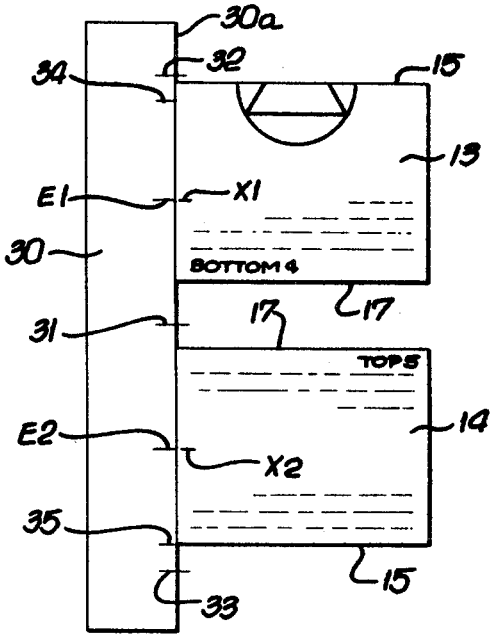

Referring to FIG. 5, the bottom of each severed page, such as page 4, is then placed on a suitable jig, such as against a straight edge 30, and the top of the next severed page, such as page 5, is also placed against the straight edge 30 below the bottom of the preceding page.

As disclosed in FIG. 5, the straight edge 30 has a mark 31 which will represent the outer edge 17 of the half sheets 12 when they are bound at their binding edge 15, and upper and lower edge marks 32, 33 spaced equal distances from the mark 31. Another mark 34 is disposed a short distance below the upper edge mark 32; whereas, another lower edge mark 35 is disposed a short distance above the lower edge mark 33. The alternative upper marks 32 or 34 and lower marks 33 and 35 are used as reference points for the binding edge 15 of one half the page. If, for example, a diagram, figure or picture has been severed in making the cut which provides the free binding edge 15, such as shown in FIG. 5, the binding edge 15 will be placed slightly below the upper mark 32, in order to secure close juxtaposition or continuity between the bottom of the severed figure, as illustrated in FIG. 5, and the top of the same figure, which appears on the top of page 4, when the binding edges are bound in the finished book, such as illustrated in FIG. 10. On the other hand, if the cut of a severed page into its top and bottom halves has been made to one side of a line of type, that is, between lines of type, to insure that a line of type is not severed, and that the cut is not too close to the line of type, the binding edge 15, such as the edge depicted at the top of page 5 in FIG. 5, is preferably placed to one side of, or above, the outermost reference mark 33, and preferably no higher than the alternate reference mark 35. The binding of this edge 15 in the book might leave a gap between the top of the page and the bottom of the same page, when the book is opened, but such gap is not material nor disturbing to the person viewing the opened book. However, a gap might be material in the case of the severed diagram disclosed in FIG. 4.

The jig has its outermost marks 32, 33 and its mark 31 extending inwardly from the edge 30*a* of the straight edge to a slight extent.

This jig 30 is employed for the purpose of establishing the relationship between the respective binding edges 15 of a sheet 12, when printed, and the center mark 31 which represents the ultimate outer edge or the printed sheet, with respect to upper and lower jig marks E1 and E2 which are respectively midway between the binding edge marks 32 and 33 and the free edge mark 31. When the proper positioning of the half pages 13 and 14 has been accomplished a reference mark X1 and X2 is made upon the sheets, aligned with the central reference marks E1 and E2 on the jig, the marks X1 and X2 being made in what is known in the printing trade as "drop-out" blue, since it is desired that the marks X1 and X2 not be reproduced in the succeeding procedure involving the production of printing plates from the half sheets 13 and 14.

Figure 6A:
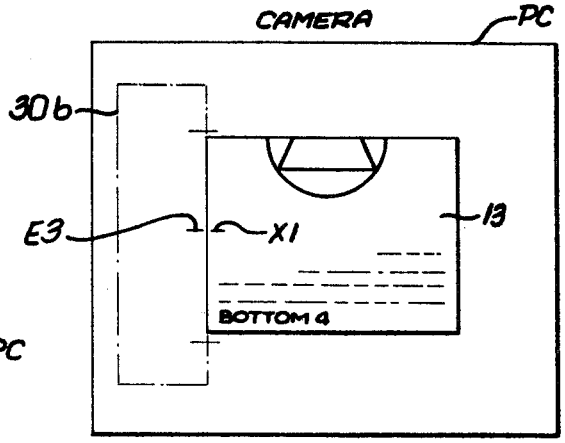
Figure 6B:
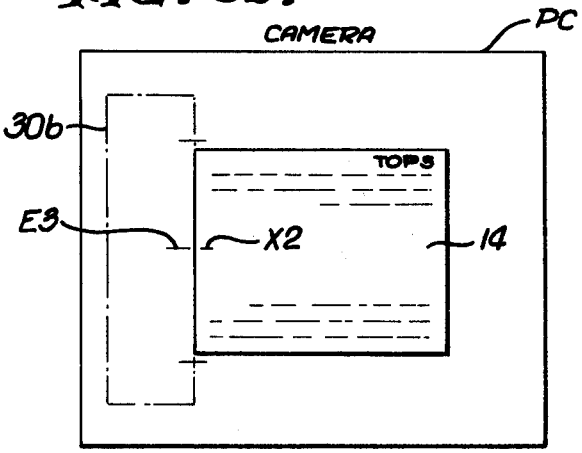

Referring to FIGS. 6*a* and 6*b*, it will be seen that the half sheet 13 has been transferred to a plate making camera of a known type having a jig 30*b* providing a registration mark E3 with which the mark X1 on the half sheet 13 is aligned, with the sheet against the straight edge of the jig 30*b*, so that a plate can be made from the half sheet 13 representating the bottom of page 4, with the binding and free edges related to the printing plate in the manner established at the jig 30 of FIG. 5. At this point, it will be understood that a printing plate is made for each bottom half of the page on each side of the sheet of the book, which is being enlarged. Correspondingly, the top half 14 of page 5, is transferred from the jig of FIG. 5 to the plate making camera PC and has the drop-out blue mark X2 thereon aligned with the registry mark E3 on the jig 30*b*, whereby a plate can be made from the top of page 5 with the binding and free edges in the same relationship on the plate as has been established at the jig 30 of FIG. 5. Here again, it will be understood that a corresponding top half plate will be made for the top of each page on the respective opposite sides of each sheet within the book being reproduced.

Since the quantities of books to be enlarged by the present process will generally be relatively small, it is not necessary to use the conventional offset printing techniques, requiring a film negative and the production of metal plates, but instead, so called "short-run" offset printing can be employed, wherein the image presented to the plate maker camera is directly transferred onto an inexpensive, plastic coated paper plate useful in single runs of limited number of impressions, and then generally discarded.

In addition to the foregoing the initial microfilming of the pages, whether the pages are enlarged then or in a later stage, has advantage in respect of reproduction of books which are printed in black and white or in color, since the microfilming and reproduction process eliminates the color, but reproduces a good image in black and white. The short-run offset plate can copy the black and white image to produce a high quality output on a very economical basis.

Figure 7:
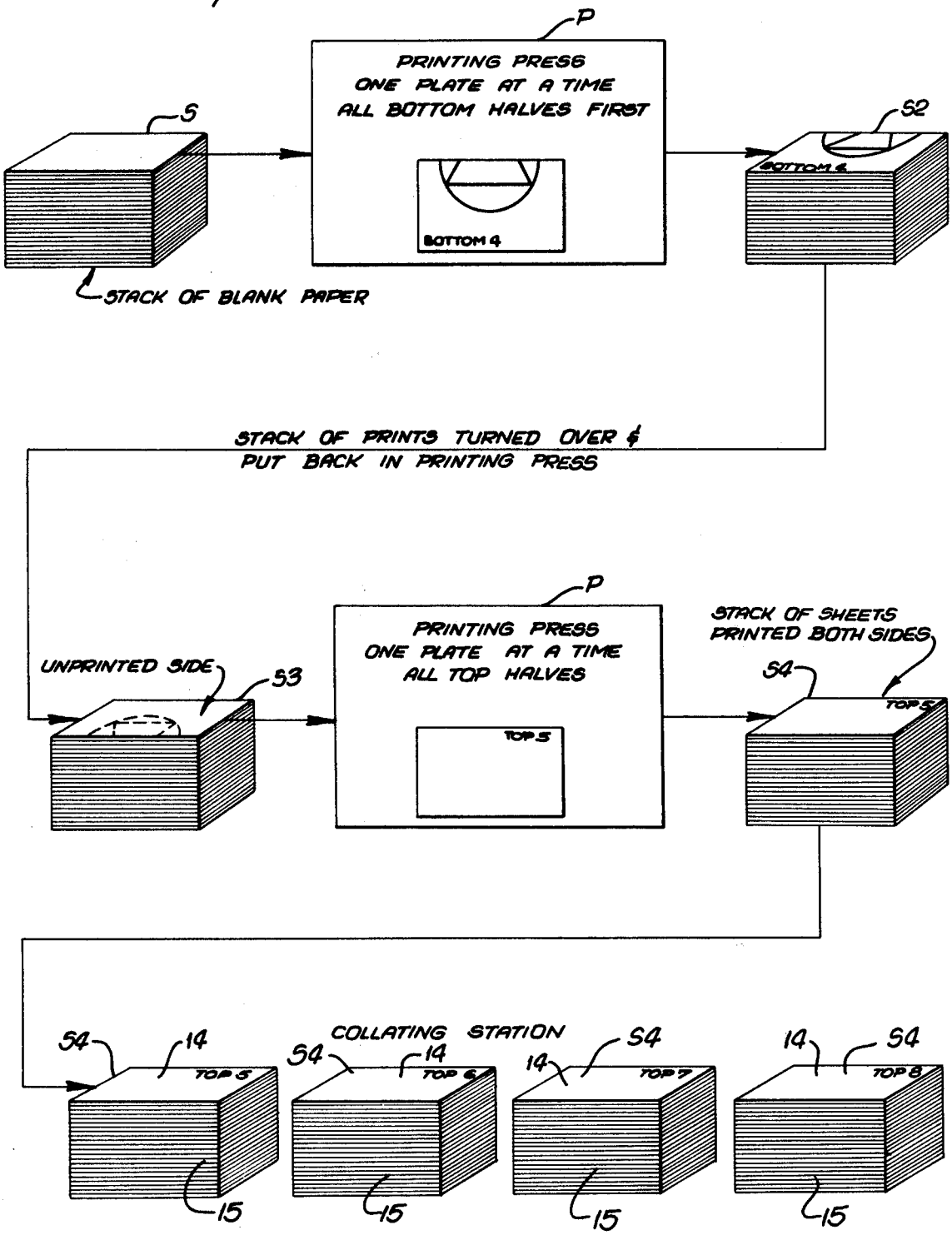
Figure 8:
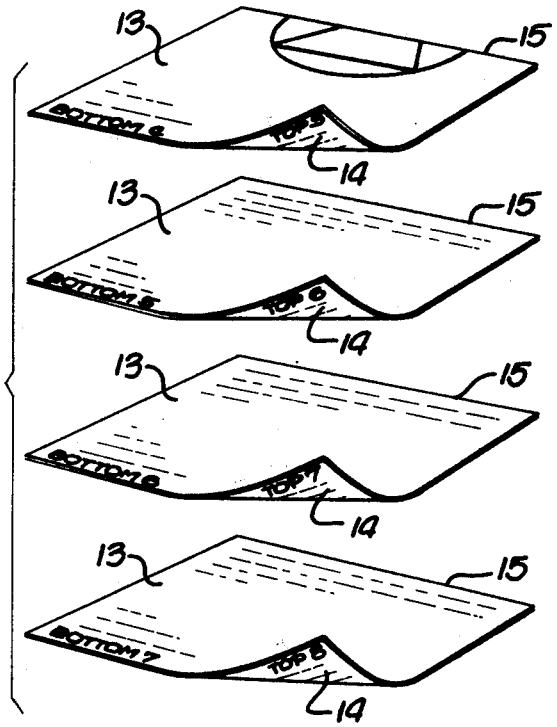

Referring now to FIG. 7, there is illustrated in a diagramatic fashion the procedure for utilizing the plates provided at the plate cameras for producing half sheets having the matter from the bottom of page 4 on one side thereof and the matter from the top of page 5 on the other side thereof. A stack S1 of blank paper sheets, corresponding in size to the half sheets 12 of the enlarged book are provided and supplied to a printing press P having therein the plate representing the bottom of page 4. The sheets are fed through the press P to provide an output of the sheets having the bottom of page 4 printed on one or the top side thereof and forming a stack S2. The stack S2 of sheets is then turned over to form a stack of sheeets S3, printed on one side to provide the bottom of page 4, and adapted to be fed through the press P which has now been provided with the plate bearing the top of page 5 thereon, and as the sheets are fed through the press, there is formed a stack of sheets S4, printed on both sides by the respective plates, having the bottom of page 4 and the top of page 5 printed thereon. This stack of printed sheets S4 is then transferred to a collating station, where subsequent stacks of sheets printed on both sides to complete the pages of the book being reproduced are also transferred for collating. The collating can be done either manually or by a collating machine, as illustrated in FIG. 8.

As seen at the collator station in FIG. 7, the several stacks of printed sheets S4 are arranged with the tops 14 uppermost and the bottoms 13 lowermost, and with the binding edges 15 all facing in the same direction. Thus, the collating step involves sequentially removing from the stacks S4 and placing one on top of the other the sheet bearing the lowest page number and progressively the higher page numbers, as illustrated in FIG. 8, so that the collated sheets can then be bound in the cover at the binding edge 15 thereof.

When the completed book is utilized and opened as seen in FIG. 10, the pages present at opposite sides of the binding line, the top of page 4 at the top of the binding line and the bottom of page 4 at the bottom of the binding line, with the bottom of page 3 on the reverse of the top of page 4 and the top of page 5 on the reverse of the bottom of page 4, and with the printed matter or designs or images on the pages in proper registry and without significant interruption in the continuity.

From the foregoing it will be apparent that the method is particularly adapted for making short-run multiple enlarged copies from an original book, with the overall size of the book, except for its thickness, being substantially the same as the original book. If the printing plates have been destroyed and it becomes desirable to make an additional run, the previously marked sheet halves utilized in preparing the plates can be again run through the plate making camera and the printing and collating procedures repeated.

Figure 2:
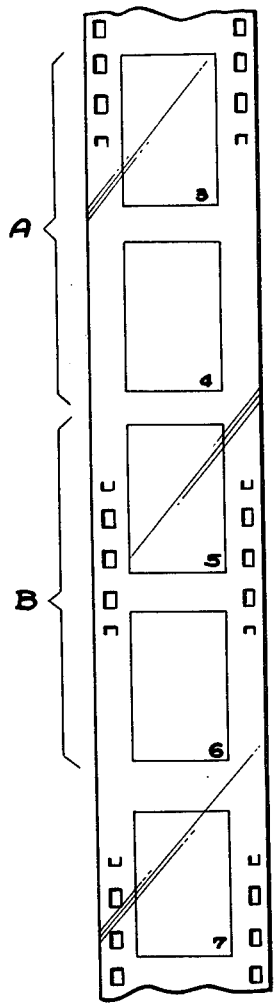

Enlarging the pages as seen in FIG. 3 is not essential to the practice of the method, since other enlargement is useful or, for that matter, the pages from each side of the sheet disclosed in FIG. 1 can be reproduced in the same size as disclosed in FIG. 1. However, it is more convenient in effecting the severing step and the proper placement of the severed half sheets on the jig of FIG. 5 to produce the enlarged prints of FIG. 3 before the severing and jig locating steps are performed.

By virtue of the method and the book disclosed, the book produced is of substantially the same size when closed as the original book of which it is a replica, but with the material on each page enlarged to the desired extent, rendering it properly and functionally visable to an individual who may be classed as "legally blind", but who has sufficient vision to permit the reading of the enlarged type sizes and figures of the large print book. The printed half pages of each sheet produced by applicant's technique enables the finished book to be produced in less time and with greater accuracy than prior methods, in quantities which can be economically supplied.

I claim

1. A method of producing large print size books from a original book of smaller print size, comprising: utilizing a copy of each page of said original book to provide individual first sheets; severing each first sheet approximately in half to produce copies of the top half and the bottom half of each page; printing an enlarged copy of the bottom half of each first sheet and the top half of each first sheet on opposite sides of individual second sheets with the enlarged bottom of a page and the enlarged top of the succeeding page in a predetermined relation to an edge of said second sheets; and binding said second sheets together at said edge with the top half of each page of said original book enlarged from said first sheet at one side of the binding and the bottom half of each page of said original book enlarged from said first sheet at the other side of the binding.

2. A method as defined in claim 1; including establishing said predetermined relation of the top and bottom of said pages by placing said copies of said top and bottom halves of the pages on a jig and providing a reference mark on said copies; and preparing printing plates from said copies with the copies registered by said mark.

3. A method as defined in claim 2; including preparing said plates by a plate maker camera; said reference marks being non-reproducible by said camera.

4. A method as defined in claim 1; including making an enlarged copy of each page on said individual first sheets.

5. A method as defined in claim 1; including microfilming the pages of said original book, making said copy of each page on said first sheets from the microfilm and enlarging said copy.

6. A method as defined in claim 1; including microfilming the pages of said original book, making said copy of each page on said first sheets from the microfilm and enlarging said copy before severing said first sheets, making printing plates from the respective tops and bottoms of the enlarged copies with the cut edge of the halves of said first sheets registered on said plates to establish said predetermined relation during said printing.

7. A method as defined in claim 1; including printing the respective top half of each first sheet and the bottom half of each first sheet by preparing plates from said halves of said copies of said first sheets having thereon the bottom of one page and the top of the succeeding page, running blank second sheets through a printing press and printing on opposite sides of said blank second sheets with said plates.

8. A method as defined in claim 1; including printing the respective top half of each first sheet and the bottom half of each first sheet by preparing printing plates from said halves of said copies of said first sheets having thereon the bottom of one page and the top of the succeeding page, running blank second sheets through a printing press and printing on opposite sides of said blank second sheets with said plates, and then collating said second sheets for binding.

9. A method of producing a large print size book from a book originally of smaller print size, comprising: providing a microfilm of each page of the book, making from said microfilm of each original book page an enlarged image on a printing plate of the top half and bottom half of each page, printing with said plates in a predetermined binding relation on one side of a single sheet the bottom half of a page and on the other side of said single sheet the top half of the next succeeding page, and binding said single sheets together whereby each enlarged top half of an original book page is disposed above the binding and the enlarged bottom half of the same original book page is disposed below the binding when the book is in opened condition.

10. A method as defined in claim 9; including producing from said microfilm a print of the bottom half of each page and another print of the top half of the succeeding page, and making said printing plates from said prints.

11. A method as defined in claim 10; wherein said plates are made by a plate maker camera.

12. A method as defined in claim 9; including producing from said microfilm an enlarged print of each page; severing said enlarged print approximately across the middle of the page to provide one enlarged copy of the bottom of each page and another enlarged copy of the top of each page, and making said enlarged image-on said printing plates from said enlarged copies by a plate maker camera.

13. A method as defined in claim 12; said predetermined binding relation being established by locating the respective enlarged copies in said plate maker camera with the severed edge of each enlarged copy located with respect to the severed edge of the other copy to provide predetermined binding portions and top and bottom margins.

14. A method as defined in claim 12; said predetermined binding relation being established by locating the respective enlarged copies in said plate maker camera with the severed edge of each enlarged copy located with respect to the severed edge of the other copy to provide predetermined binding portions and top and bottom margins, and printing on one side of said single sheets first with one of said plates, then printing on the other side of said single sheets with the other of said plates, and collating said single sheets with said binding portions together with all of the bottoms and all of the tops arranged sequentially and facing oppositely.

* * * * *